US005351337A

United States Patent [19]

Deutsch

[11] Patent Number: 5,351,337

[45] Date of Patent: Sep. 27, 1994

[54] SELF-CONTAINED PRESSURIZED WATER DELIVERY SYSTEM

[76] Inventor: Joseph J. Deutsch, 86 Pine Dr., Mariners Cove, Millsboro, Del. 19966

[21] Appl. No.: 950,948

[22] Filed: Sep. 25, 1992

[51] Int. Cl.[5] ..... F24H 1/00

[52] U.S. Cl. ..... 392/450; 392/451; 392/463; 122/13.2; 236/24.5; 137/563

[58] Field of Search ..... 122/4 A, 13.2; 137/563; 236/24.5; 392/449, 450, 451, 463, 464, 471, 475; 210/194

[56] References Cited

U.S. PATENT DOCUMENTS

| | | | |
|---|---|---|---|
| 2,192,383 | 3/1940 | Krolop | 392/444 |
| 2,630,412 | 3/1953 | Besler | 239/135 |
| 2,786,211 | 3/1957 | Culver | 4/626 |
| 3,694,826 | 10/1972 | Pugh | 4/516 |
| 3,809,858 | 5/1974 | Boggs | 392/451 |
| 3,983,583 | 10/1976 | Herman et al. | 4/626 |
| 4,140,150 | 2/1979 | Rundell | 222/146.1 |
| 4,180,374 | 12/1979 | Bristow | 417/12 |
| 4,298,022 | 11/1981 | Walters | 137/341 |
| 4,371,779 | 2/1983 | Maynard et al. | 392/449 |
| 4,471,631 | 9/1984 | Anstey et al. | 62/177 |
| 4,594,500 | 6/1986 | Wright | 392/471 |
| 4,765,003 | 8/1988 | Chang | 4/626 |
| 4,947,025 | 8/1990 | Alston et al. | 392/471 |
| 4,969,991 | 11/1990 | Valadez | 210/96.2 |
| 4,974,500 | 12/1990 | Boyd et al. | 4/516 |

OTHER PUBLICATIONS

M & E Marine Supply Company Catalog, 1991, p. 94 ("Par Catalog").

*Primary Examiner*—Bruce A. Reynolds
*Assistant Examiner*—Gregory L. Mills
*Attorney, Agent, or Firm*—Sanford J. Piltch

[57] ABSTRACT

An improved self-contained pressurized water system for use in remote areas, vehicles, or whenever conventional sources of potable water are not readily available including at least one pressure detection switch for rendering system inoperative and incorporating a flow path for recirculation and aeration of stored water.

7 Claims, 4 Drawing Sheets

SELF-CONTAINED PRESSURIZED WATER DELIVERY SYSTEM

FIELD OF THE INVENTION

The present invention relates generally to self-contained water delivery systems for use where centralized water delivery systems and/or potable well water are not available and, more particularly, to self-contained water systems adapted to safely provide hot and cold running water from a limited capacity reservoir.

BACKGROUND OF THE INVENTION

In many remote and rural areas, sources of potable water are not readily available. Consequently camping, exploratory and other parties penetrating these areas are usually required to bring in much, if not all, of the water needed for drinking, cooking, washing and sanitary applications. Similarly, with motor homes, small yachts and other small and medium sized passenger carrying boats, it is usually necessary to pack drinking water as part of their working supplies whenever they are away from a serviced source of water.

To meet these needs, a number of prior art systems have been developed. For example, Culver, in U.S. Pat. No. 2,786,211, discloses an easily installed self-serving sink for use in providing domestic running water to rural homes which are both connected to an electric utility line and have an available source of potable water, such as a well or a nearby stream. The sink is designed to be easily installed and serviced with a minimum of special tooling involved.

Widely used in many of these applications are a number of automatic water pressure systems produced by PAR. These generally comprise an in-line electric pump adapted to draw water from an onboard water supply tank and direct it either to a hot water heating and storage tank or to pressurize the system for direct flows of both hot and cold water to one or more of a series of water outlets for washing or drinking. However, while the pump is a self-priming and can safely be run dry, the hot water system is typically not protected against low water pressure and could suffer serious damage in the event that either the water supply tank or storage tank runs dry. Neither are these systems adapted to allow long term storage of the water without having problems caused by algae and other growths in the system.

Even a cursory review of the prior art reveals many other captive systems for supplying potable water in marine environments or other remote areas. Such a review shows that all of them are basically similar in their mode of operation and, accordingly, exhibit the same features, in one form or another. For example, almost all of these systems rely on a preexisting self-stored source of potable water and they operate on a once-through basis, i.e., they do not include any means to recirculate and reaerate the residual water stored therein. As a result should these systems be inoperative for long periods of time, such as over the winter, it is necessary to drain them completely to prevent algae and bacterial contamination from forming and accumulating in the stagnant water.

SUMMARY OF THE INVENTION

The self-contained pressurized water delivery system of the present invention provides a supply of hot and cold running water from a limited capacity reservoir. In common with most prior art systems used for this purpose, the water delivery system of the present invention contains a water supply reservoir, which provides the source of cold water, a hot water heater and storage tank and a pumping system to propel the stored water to one or more faucets or other system outlets with water pressure being maintained by a captive air tank which exerts a static pressure on the water line at all times. However, unlike these systems, the pressurized water system of the present invention contains at least one, but preferably a plurality of pressure detection switches which act as electric and hydraulic system disconnects whenever the water system volume or pressure drops below a preset level. The system of the present invention further includes means for maintaining the potability of the water over long periods of non-use by incorporating a capability to circulate and aerate the water being stored therein on a more or less continuous basis.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE INVENTION

The following detailed description is of the best presently contemplated mode of carrying out the invention. This description is not intended in a limiting sense, but is made solely for the purpose of illustrating the general principles of the invention.

The various features and advantages of the present invention may be more readily understood with reference to the following detailed description, taken in conjunction with the accompanying drawings, wherein like numbers refer to the same feature or part thereof.

Figure 1:
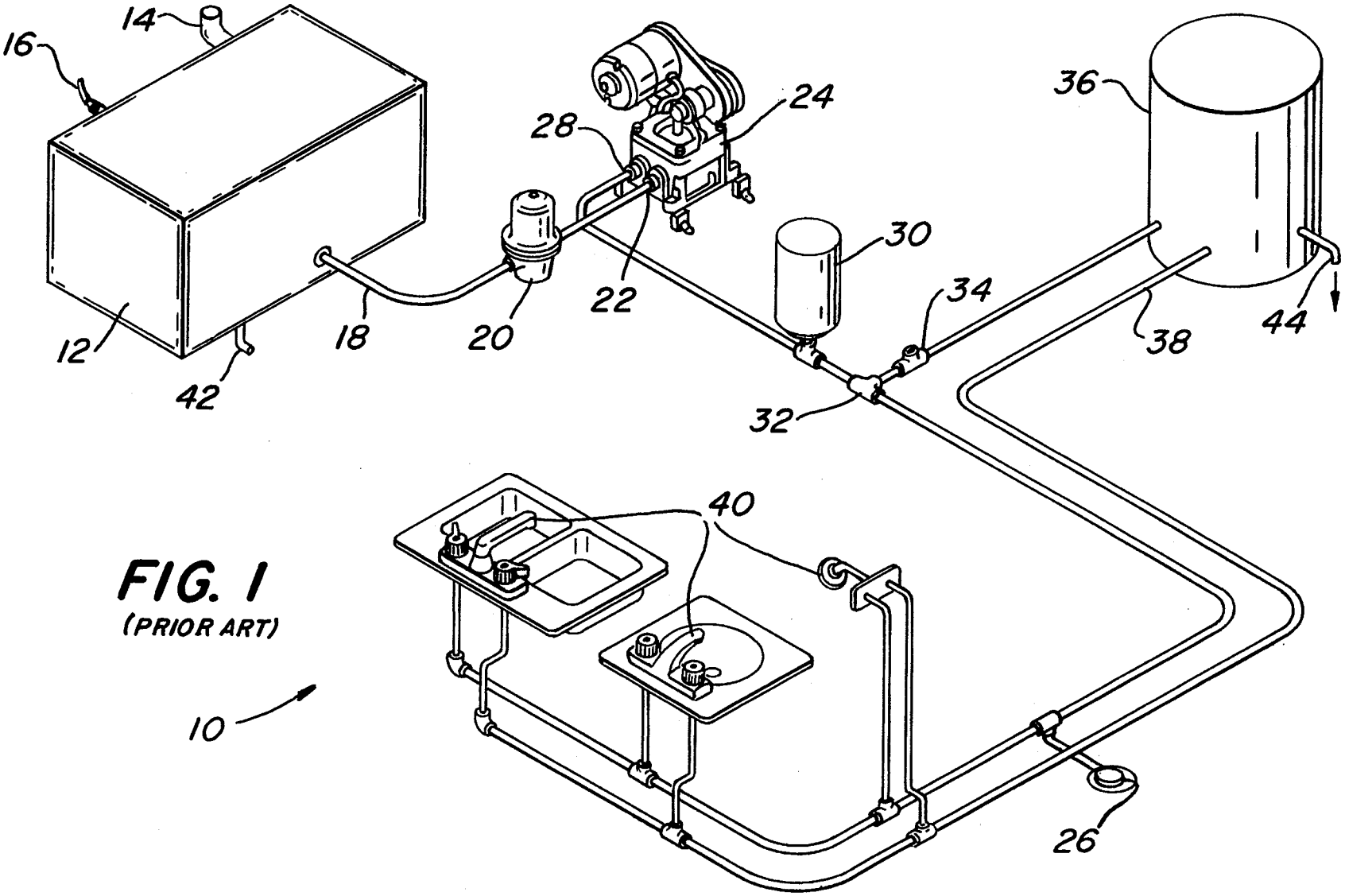
FIG. 1 (PRIOR ART)
FIG. 1 is a schematic diagram of a prior art system for providing hot and cold running water in house trailers, small boats and similar applications.
Figure 2:
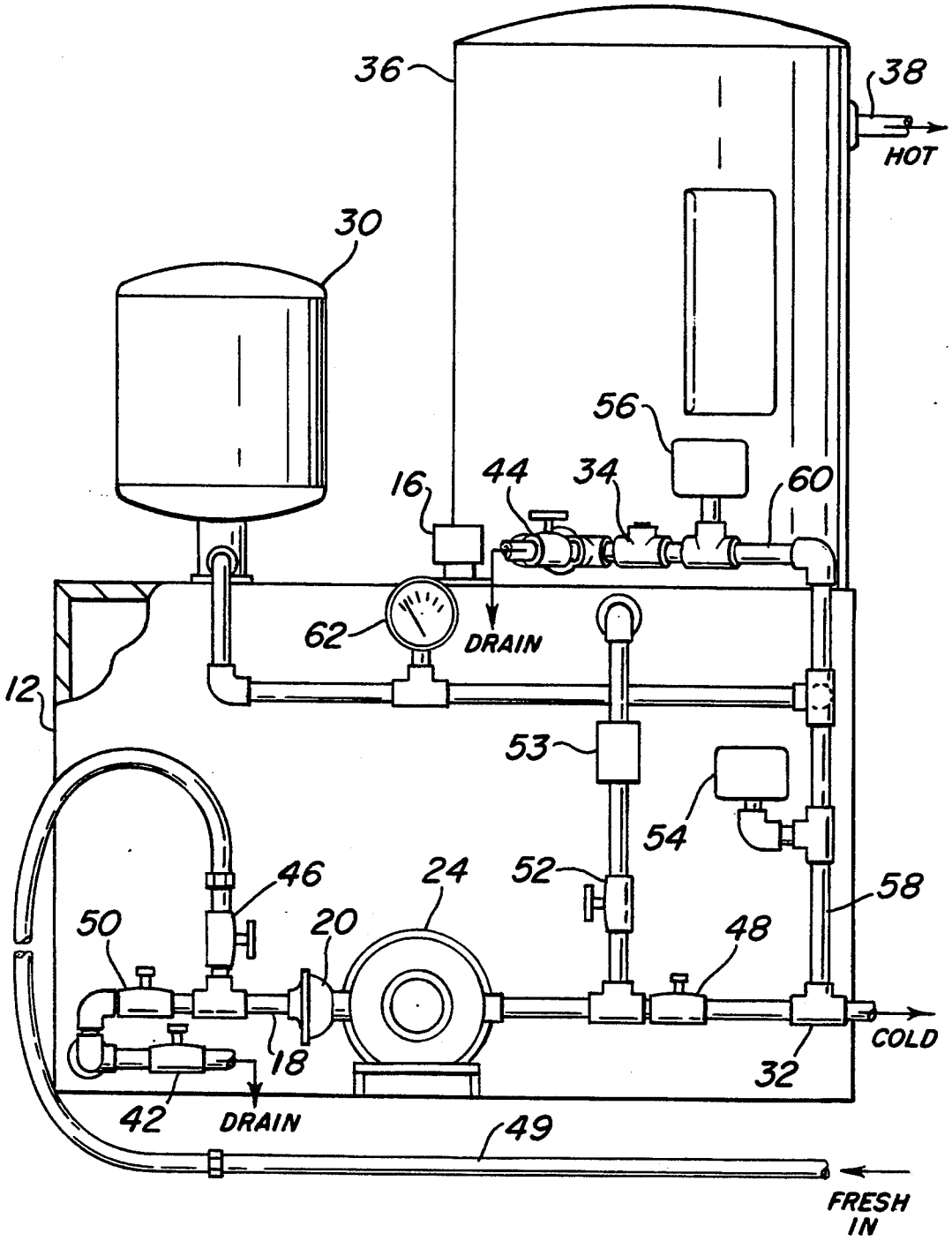
FIG. 2 is a view of a front elevation of the self-contained pressurized water delivery system of the present invention.
Figure 3:
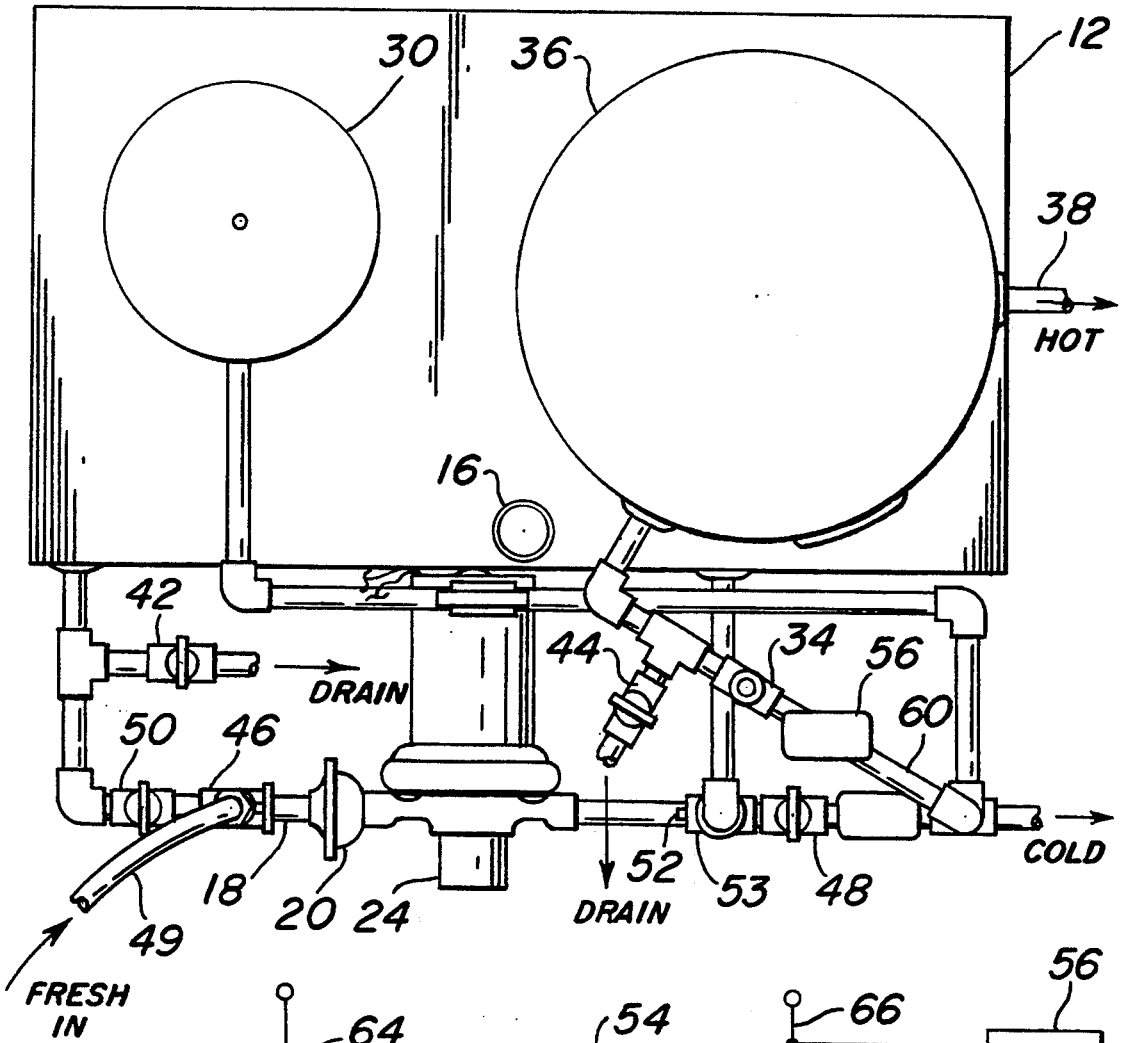
FIG. 3 is a top view of the water delivery system of FIG. 2.

Shown as FIG. 1 is a schematic drawing of a widely used prior art water system 10 which is typical of those used to provide a supply of hot and cold running water in small boats, motor homes and similar applications where a source of electric power is available. As shown therein, such a system provides a water supply tank or reservoir 12 having a tank fill inlet 14, an air vent 16 and a cold water outlet line 18. Initially, this tank is filled with water, which may be from a municipal or other potable water source, or a supply from bottles, "Jerry" cans or other water containers, usually brought in with the system and manually added to it. Regardless of the water source used, the size of tank 12 will be dependant upon the intended time of use and the subsequent availability of refill sources.

Outlet line 18 leads, in turn, first to a strainer 20 to remove any solid particles of dirt or rust suspended in the water supply, and then to the inlet 22 of an automatic, positive displacement self-priming diaphragm water pressurizing pump 24, which reacts in response to a low pressure signal transmitted by a single downstream pressure sensor 26, usually when a tap is opened. Pumps of this type are available for both AC and DC sources of power, and they can provide an output of about 10 liters/minute at an outlet pressure of about 20 psi. Typically, these pumps can operate safely even when the system is dry.

Downstream from the outlet 28 of pump 24 is an air accumulator surge tank 30 which acts to maintain an even system pressure and, further, to facilitate a smooth flow of water, whenever a tap is opened, by preventing water surges or "water hammers." This pressure maintenance capability serves to eliminate the frequent on/-off cycling of pressurizing pump 24 as water is drawn from the system. Once past surge tank 30, the water stream is divided at point 32, with part flowing through check valve 34 into a hot water storage tank 36 having an outlet line 38. Tank 36 is typically electrically heated, usually from the same power source as that used to operate pump 24, and check valve 34 prevents a reverse flow of the heated water back into the cold water line 18. Cold water line 18 and hot water line 38 then lead to one or more outlets 40 such as a shower head, washing machine, lavatory sink or galley sink.

One common problem with water systems of this basic design is that they typically require that the system be drained through drain valves 42 (for stored cold water) and 44 (for any hot water present) when not in use to prevent the formation of deaerated and/or algae laden stagnant water.

The basic self-contained pressurized water delivery system of the present invention is shown in FIGS. 2 through 5. For convenience, the numbers identifying the various constituent parts and features therein will be the same as those used to identify similar parts and features in the prior art system discussed above, as an examination of the present system will show that it contains many, if not most, of these same parts and features. However, the present invention comprises a number of significant differences and improvements, as compared to the prior art system which serve to overcome many of the limitations discussed above. Thus, pump 24 is a multi-purpose in-line pump which is used not only to force the water through the system to hot water storage tank 36 or to a user controlled outlet, as described above, but also to provide the means for quickly replenishing the water supply in reservoir 22 from an external source, as shown, for example, in FIG. 4 and to recirculate and aerate the stored water on either a continuous or time controlled basis.

The accomplishment of these differing purposes is achieved by the controlled opening and closing one or more of a plurality of valves set into the water handling lines. Thus, filling is accomplished by opening inlet valve 46 and cold water outlet valve 52, with circulation valves 50 and 48 being closed. With the four valves set in these positions, operation of pump 24 will now draw water from the external source and cause it to flow through inlet piping 49 into and fill both cold water storage tank 12 and hot water tank 36, thus providing the initial charge of water into the system. While the embodiment discussed above and illustrated in FIG. 4 shows the system being charged with potable water from a canned or bottle source 51 at the start of operation, it is also contemplated that the water source is a river or other stream, or is taken from a contaminated or brackish supply. In either of these cases, the water inlet portion of the system can easily be modified to further include passing the incoming water stream through one or more subsystems to produce potable water. Such subsystems would include, without limit, one or more filters to remove dirt and other solid materials, a bed of activated charcoal to remove dissolved organic material and/or an ion exchange/water softener resin to remove dissolved inorganic salts, and means for adding one or more bactericides, algecides or fungicides such as chlorine tablets or liquid bleach. Small units to perform each of these functions, either alone or in combination, are readily available from many sources, and the inclusion of such functions to produce potable water for the initial charge to tanks 12 and 36 is contemplated for the present invention.

During normal operation of the system, valves 46 and 52 are closed while 48 and 50 are opened with pump 24 operating whenever the outlet line pressure drops to some predetermined level. Recirculation and aeration of the charge water is accomplished by closing valves 46 and 48 and opening valves 50 and 52 with pump 24 now circulating the water through the loop thus established so that it contacts fresh air being drawn into tank 12 through vent 16. It will be appreciated that although the above discussion describes the manual operation of these valves, the inclusion of a control subsystem which would permit the remote massed opening and closing of the valves used for the initial water fill and for the subsequent recirculation and/or discharge of the water therein could be accomplished automatically, would be a fairly simple and straightforward matter. Furthermore, where it is desired to accomplish this recirculation only at particular times, the start and time lengths of such recirculation could be easily set up and run by the addition of an onboard timer (not shown). Regardless of how it is to be done, the recirculation/aeration capability of the present invention permits the safe long term storage, even the freezing, of the water in storage tank 12 without algae formation or stagnation becoming a problem.

A second novel feature of the water system of the present invention is the inclusion of at least two low-pressure detection switches 54 and 56 respectively to protect the system from potential damage due to low water level or pressure. Switch 54 is a pressure actuated valve located in the outlet line 58 from pump 24 which is present to detect and respond to a low output pressure in line 18. This operation is different from that of pressure sensor 26, in that it serves to protect the system from "dry" operation, unlike the sensor 26 which merely signals the pump to turn "on" when some slight lowering of the water pressure is detected as, for example, when a shower is operating. Typically, pressure sensitive switch 54 will have an indicator light (not shown) which will indicate when it is "on" and the cold water outlet line 18 line is closed, so that the user of the system can be alerted to refill storage tank 12.

Switch 56, which is located in hot water inlet line 60, serves to protect the heating element in hot water storage tank 36. While normal operation of the system will cause pump 24 to operate to keep the system pressure fairly constant whenever a relatively large quantity of water is needed as, for example, for dish washing or showers, the normal gravitational force of the water remaining in tank 12 falls as the level is lowered. However, unless storage tank 12 is practically empty, the outlet pressure in line 18 will not fall below the predetermined level needed to trigger switched valve 54. When the water level in tank 12 does fall below a level needed to replenish hot water 34, i.e., the system is essentially dry, the detection of a "low" pressure in hot water inlet line 60 or a low pressure signal from switched valve 54, will actuate switch 56 and cause it to disconnect the power to the heating element, thus preventing overheating and possible burnout of the element and reducing the potential for fire. Both of these switches are set to operate should the pressure in the monitored lines be reduced to below some preset value, typically from about 5 to about 10 psi, for any significant length of time. Since the nominal water pressure in the system, as set up by the pressure in air accumulator surge tank 30, as indicated by gauge 62, is typically from about 15 to 20, more usually from about 17 to about 18 psi, such a low pressure level would normally only be reached when storage tank 12 is substantially empty.

Figure 5:
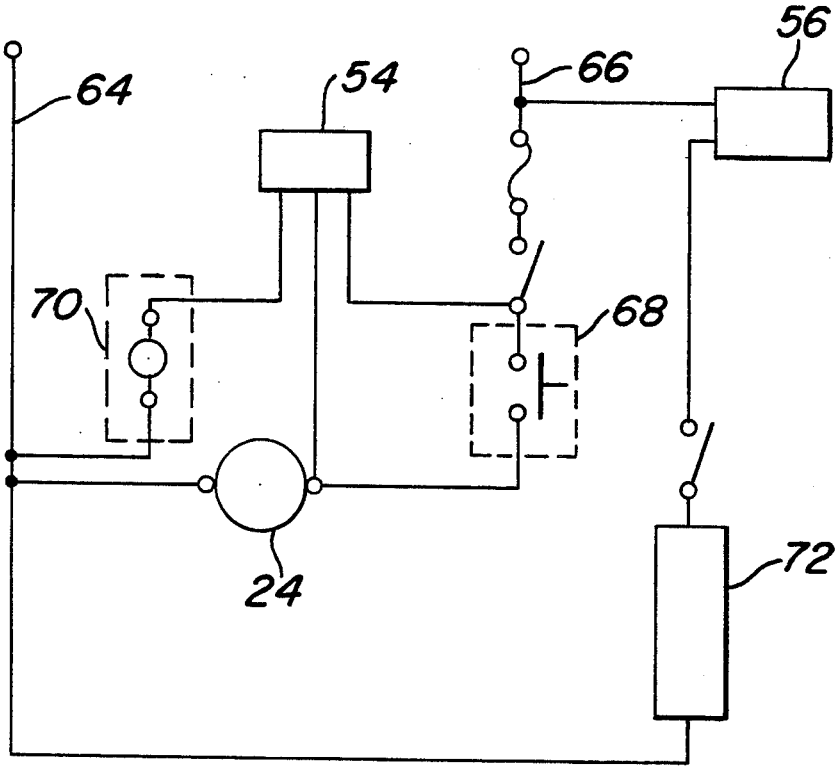
FIG. 5 is a schematic electrical circuit diagram for the water delivery system of FIG. 2.
Figure 4:
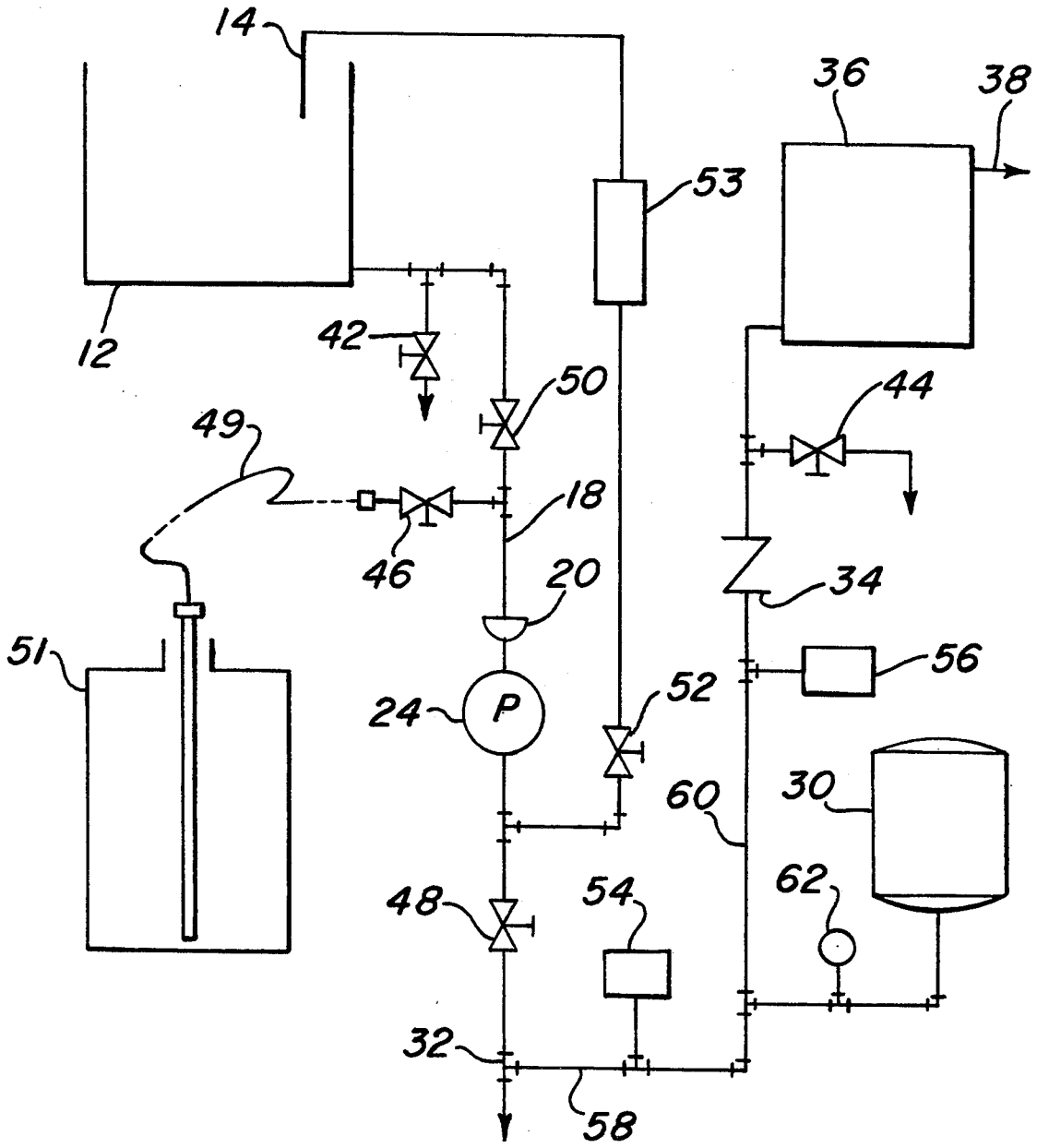
FIG. 4 is a schematic piping diagram for the water delivery system of FIG. 2.

The basic operation and location of these features are further illustrated in the schematic piping and electric diagrams shown as FIGS. 4 and 5 respectively. FIG. 5 further shows the electric utility lines 64 and 66 which may either be from a public utility overhead line or from a portable electric generator, which may be a subsystem of the present invention, a pump/system on/off switch 68, low inlet indicator pressure switch valve 54 and indicator light 70, hot water heating coil 72 and low hot water inlet pressure switch 56, all of which operate in the manner described above.

Thus there has been described a new and improved self-contained pressurized water delivery system. It is to be understood that the above-described embodiments are merely illustrative of the many specific embodiments which represent applications and uses of the present invention. Clearly, numerous other arrangements can be readily devised by those of skill in the art without departing from the spirit and scope of the invention as defined in the appended claims and all changes which come within the scope and equivalency of these claims are intended to be embraced therein.

I claim:

1. An improved self-contained pressurized water system of the type comprising a source of electric power, an air-vented limited capacity cold water reservoir, a hot water heater including a limited capacity hot water storage tank, a pressure surge tank for maintaining the output pressure of the water system and pump means for drawing a supply of water from said reservoir and providing said supply either to said hot water storage tank or to one or more user operated outlets, all of these components being interconnected with associated inlet and outlet piping and valves to control the rate and time of the output flow of hot or cold water from said system, wherein the improvement comprises:

(a) a low pressure switched valve in the outlet line from said reservoir adapted to close the outlet from said reservoir and to shut off said pump means whenever the output pressure from said reservoir falls below a preset level;

(b) a low pressure actuated switch in the inlet line to said hot water heater adapted to shut off the power to a heating element in said hot water storage tank whenever the inlet water pressure to said storage tank falls below a preset level; and (c) means for circulating and aerating the water in said cold water reservoir.

2. The improved water system of claim 1 wherein said hot and cold water low pressure switches are set to operate when the output water pressure from said reservoir falls to a level between about 5 and about 10 psi.

3. The water system of claim 1 further comprising means for drawing water from an external source.

4. The water system of claim 1 wherein said water circulating and aerating means comprises a set of valves in the water inlet and outlet lines of said system which can be configured, as required, to cause said pump to draw water from an external source to replenish the supply in said reservoir and hot water storage tank, to pressurize the system and then to circulate stored cold water past said air vent to prevent stagnation and to substantially reduce problems resulting from the growth of algae, bacteria and fungi in the water during long term storage.

5. The water system of claim 4 wherein said water drawn from an external source is first passed through one or more means for rendering it potable prior to storing it within said system.

6. The water system of claim 4 further comprising control means for ganging the valves used to configure the system so as to cause it to draw, circulate and supply pressurized water in a controlled manner.

7. The water system of claim 6 wherein said control means further comprises means to set up particular operating times and time durations for said water circulation.

* * * * *